US009774152B2

(12) United States Patent
Los

(10) Patent No.: US 9,774,152 B2
(45) Date of Patent: Sep. 26, 2017

(54) FORWARD AND BACKWARD COMPATIBLE 5 POLE AUDIO PLUG AND JACK SYSTEM

(71) Applicant: Oleg Los, Buffalo grove, IL (US)

(72) Inventor: Oleg Los, Buffalo grove, IL (US)

( * ) Notice: Subject to any disclaimer, the term of this patent is extended or adjusted under 35 U.S.C. 154(b) by 0 days.

(21) Appl. No.: 14/627,964

(22) Filed: Feb. 20, 2015

(65) Prior Publication Data

US 2015/0244116 A1 Aug. 27, 2015

Related U.S. Application Data

(60) Provisional application No. 61/943,668, filed on Feb. 24, 2014, provisional application No. 62/033,654, filed on Aug. 6, 2014.

(51) Int. Cl.

*H01R 24/04* (2006.01)
*H01R 24/58* (2011.01)
*H01R 107/00* (2006.01)

(52) U.S. Cl.

CPC ..... *H01R 24/58* (2013.01); *H01R 2107/00* (2013.01)

(58) Field of Classification Search

CPC H01R 24/58; H01R 2103/00; H01R 2105/00; H01R 2107/00; H01R 23/025
USPC ..... 439/668, 669, 676
See application file for complete search history.

(56) References Cited

U.S. PATENT DOCUMENTS 7,450,726 B2 11/2008 Goyal
7,789,712 B1 * 9/2010 Peng ..... H01R 24/58 439/668
7,824,230 B1 * 11/2010 Ho ..... H01R 13/405 439/669
7,942,705 B2 * 5/2011 Murphy ..... H01R 13/2421 439/668
7,976,347 B2 * 7/2011 Zhang ..... H01R 24/58 439/668

(Continued)

FOREIGN PATENT DOCUMENTS

EP 2175530 A1 4/2010
JP 5-57787 U 7/1993

(Continued)

OTHER PUBLICATIONS

International Telecommunication Union, ITU-T p. 381 "Series P: Terminals and Subjective and Objective Assessment Methods".

(Continued)

*Primary Examiner* — Hien Vu
(74) *Attorney, Agent, or Firm* — Patents and Licensing LLC; Daniel W. Juffernbruch

(57) ABSTRACT

A backward compatible five-contact audio plug and jack system that provides for connecting to five separate channels of an audio accessory including two speaker channels and two microphone channels. The audio plug includes an added smaller diameter ring contact positioned within a longitudinal position normally occupied by tip contact of a conventional 4-contact audio plug and specifically located within 5.1 mm of a tip of the five-contact audio plug. The jack contact for the tip contact of the plug and the jack contact for the added smaller diameter ring contact are within 4.75 mm of each other, preferably at a distance between 1.5 mm and 2.5 mmm. The smaller diameter ring contact has a maximum diameter that is smaller than a maximum diameter of the tip contact specified in ITU P.381 standard which is 3.05 mm.

9 Claims, 11 Drawing Sheets

(56) References Cited

U.S. PATENT DOCUMENTS

| | | | | |
|---|---|---|---|---|
| 8,041,047 | B2 | 10/2011 | Matsumoto et al. | |
| 8,192,234 | B2 * | 6/2012 | Wittenberg | G01D 21/02 439/620.21 |
| 2010/0279553 | A1 | 11/2010 | Izumi | |
| 2012/0196487 | A1 * | 8/2012 | Dobler | H01R 13/7033 439/668 |
| 2013/0158919 | A1 | 6/2013 | Shah et al. | |
| 2014/0050330 | A1 | 2/2014 | Allen et al. | |

FOREIGN PATENT DOCUMENTS

| | | | |
|---|---|---|---|
| JP | H06111876 | A | 4/1994 |
| JP | H0742042 | A | 7/1995 |
| JP | H0742042U | A | 7/1995 |
| JP | 2545747 | | 5/1997 |
| JP | 3078619 | | 6/2000 |
| JP | 3078619 | U | 4/2001 |
| JP | 2001217053 | | 8/2001 |
| JP | 2001217053 | A | 8/2001 |
| JP | 2001230031 | A | 8/2001 |
| JP | 2002-134237 | | 5/2002 |
| JP | 2003297501 | A | 10/2003 |
| JP | 2003303649 | A | 10/2003 |
| JP | 2003308933 | A | 10/2003 |
| JP | 2175530 | A1 | 4/2010 |
| WO | WO2010021072 | A1 | 2/2010 |

OTHER PUBLICATIONS

Seth Prentice, "Simplifying Smartphone Designs with Audio Jack Detection and Configurations Switches".

Connectors for frequencies below 3 MHz for use with printed boards, Part 11: Detail specification for concentric connectors (dimensions for free connectors and fixed connectors), IEC 603-11, International Electrotechnical Commission, cover page and odd numbered pp. 5-43, first edition, Mar. 1992.

http://www.plugfactory.net/ProductView_487.html.

* cited by examiner

5 POLE PLUG IN 5 POLE JACK

FIVE POLE PLUG IN 4 POLE JACK

4 POLE PLUG IN 5 POLE JACK

Impedance report to CPU:
P4 P6 P3 P2 P1
32 NC 32 G 2K
Action: 4 pole mode

Impedance report to CPU:
P4 P3 P2 P1
32 32 G 2K
Action: 4 pole mode
Second channel mic stays disconnected Impedance report to CPU:
P4 P6 P3 P2 P1
2K 2K G G 2K
Action: 3 pole stereo mic mode

FORWARD AND BACKWARD COMPATIBLE 5 POLE AUDIO PLUG AND JACK SYSTEM

RELATED APPLICATION DATA

This patent application is based on provisional application Ser. No. 61/943,668 filed 24 Feb. 2014 and provisional application Ser. No. 62/033,654 filed 6 Aug. 2014.

FIELD OF THE INVENTION

The present invention relates to audio plugs and jacks.

BACKGROUND

Cylindrical audio plugs and corresponding jacks have been used for many decades to establish connections for electrical signals bearing audio information. Typically the equipment that either produces or records the signal would include a jack, and the peripheral equipment such as headphones or microphones would include the plug. Whereas the older audio plugs were one-quarter inch (6.35 mm) diameter, newer and smaller equipment such as Compact Disk (CD) players, MP3 players, and mobile telephone handsets use the nominally 3.5 mm (nominally ⅛") plugs and jacks.

In the past few years smartphone-type mobile telephone handsets, which have greatly increased capability in so far as video and audio processing power have proliferated in many markets including the U.S. Smartphones have very streamlined external designs typically including, for example, no more than two physical buttons, e.g., a power button and a volume rocker switch, and typically include no more than two external connectors including a combined data transfer and charging connection (e.g., Universal Serial Bus (USB) jack) and an audio jack. The streamlined, limited external design complexity of smartphones including the limited number of buttons and connectors is part of the current design paradigm which is compensated by the highly versatile user controls that can be achieved through non-physical touch screen GUI control elements.

However, the availability of only a small number of connectors on a smartphone while simplifying the user experience can be quite limiting. For example, there is a sophisticated type of audio known as binaural audio. Recording binaural audio requires two separate microphones. The two microphones can be located on a model head which is intended to reproduce the acoustics of a person's head. The two microphones can also be incorporated into earphones. The intent is two capture differences in time of arrival, and volume of sounds reaching a person's two ears so as to capture the sensation of direction of emanation of a sound. In other words to create a three dimensional (3-D) sound effect.

Another audio technology that utilizes two microphones is a certain class of noise cancellation systems. In such systems one microphone is located close to a speaker's mouth and a second microphone is located further away. Both microphones will pick up ambient noise, but the microphone closer to the person's mouth will have a stronger component of the speaker's voice. The signal obtained from the further microphone can be subtracted from that received from the closer microphone in order to reduce the noise component. The noise cancellation systems and the binaural systems can be built into a set of headphones or earphones that include two (stereo) speakers, i.e., one for each ear. In such cases two speaker channels, plus two microphone channels plus a ground connection will be required. Unfortunately, most commonly available audio plugs and jacks have four or less contacts.

Additional contacts could also be used to implement differential signaling from a microphone (as opposed to using a single wire referenced to ground). Differential signal reduces noise pickup in long leads. Yet another use of an additional contact would be to supply power to the device that includes the jack, e.g., for charging or to supply power to the audio accessory that includes the plug, e.g., for powering electrical circuits therein.

While there have been prior attempts to add a fifth contact to a plug without increasing the standard length of 3.5 mm plugs, the problem is that such plugs and the jacks made to work with them are not fully backward compatible with preexisting three-contact and four-contact plugs and jacks. This is an issue because devices that include jacks such as smartphones and devices that include plugs such as high end headphones are not necessarily sold together. A purchaser of a smartphone with a five-contact jack may own one or more sets of expensive headphones including separate ones designed for web chats and separate ones designed for listening to music that are equipped with three-contact or four-contact plugs. Similarly a person owning an expensive headset equipped with binaural microphones or noise cancellation and a five pole plug may want to use that with multiple devices that have jacks with four or less poles.

FIG. 22 is a cross sectional view of prior art plug disclosed in PCT patent publication WO2010021072 A1, published Feb. 25, 2010. The disclosed plug 10 appears to be equivalent to what has been implemented in the Sony® Xperia 2 and 3 smartphones. The approach used in this prior art design is to squeeze four contacts 12, 13, 14, 15 separated by insulating portions 22, 23, 24 into the space that would normally include only three contacts in a normal four-contract audio plug. This reduces the margin for error, and, due to real world manufacturing tolerances and design variations, a four-contact plug inserted into a jack designed for this five-contact plug may not function due to a contact of the jack touching two of the contacts of the four contact plug or resting on an insulating region between the contacts. Due to all of these issues it becomes very difficult or impossible for detection circuits that are currently used in smartphones to correctly detect such a plug.

What is needed is a five-contact audio plug that works with a five-contact audio jack that is backward compatible with three-contact and four-contact audio plugs. It would also be desirable that the five-contact audio plug be backward compatible with three-contact and four contract audio jacks.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
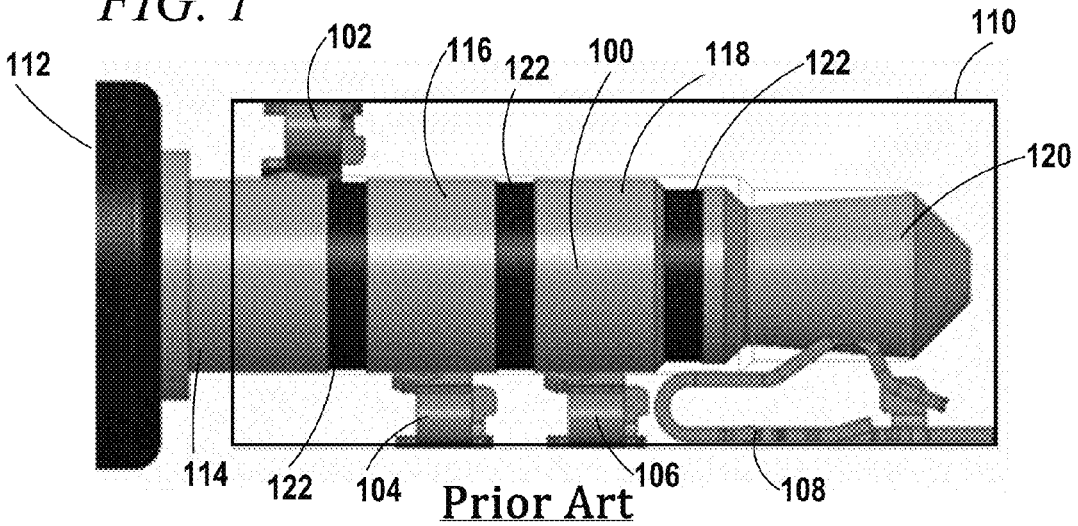
FIG. 1 is a side view of a prior art four-contact audio plug along with contacts of a compatible four-contact audio jack.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to audio plugs and jacks. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

FIG. 1 is a side view of a prior art four-contact audio plug 100 along with jack contacts 102, 104, 106, 108 of a compatible four-contact audio jack 110. An end of a rear housing/grip portion 112 of the audio plug 100 is shown at the left of FIG. 1. The left end (in the perspective of FIG. 1) of the audio plug 100 is considered the proximal end of the audio plug 100. Starting from the proximal end, the audio plug 100 includes a sleeve contact 114, a first ring contact 116, a second ring contact 118 and a tip contact 120. The four contacts 114, 116, 118, 120 are separated and held in position relative to each other by an insulating material 122. (The sleeve contact 114, the first ring contact 116 and the second ring contact 118 are considered "cylindrical" contacts.) The four jack contacts 102, 104, 106, 108 include a first jack contact 102, a second jack contact 104, a third jack contact 106 and a fourth jack contact 108 which respectively engage with the sleeve contact 114, the first ring contact 116, the second ring contact 118 and the tip contact 120 of the audio plug 100. The four jack contacts 102, 104, 106, 108 are suitably made of a resilient electrically conductive material such as beryllium copper or phosphor bronze for example.

Figure 2:
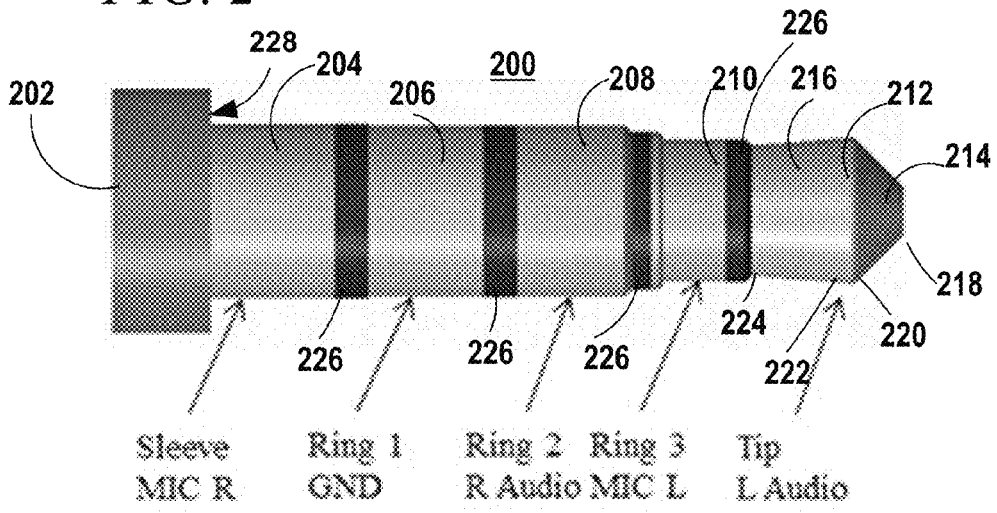
FIG. 2 is a side view of backward compatible five-contact audio plug according to an embodiment of the invention.

FIG. 2 is a side view of backward compatible five-contact audio plug 200 according to an embodiment of the invention. The five-contact audio plug 200 includes a rear housing/grip portion 202 at the left side of FIG. 2 which is considered the proximal end of the plug 200. In order from the proximal end, the five-contact audio plug 200 includes a sleeve contact 204, a first ring contact 206, a second ring contact 208, a third, smaller diameter ring contact 210, and a reduced length tip contact 212 which has a length reduced relative to the prior art plug shown in FIG. 1 and reduced relative to length specified in the International Telecommunication Union standard P.381 which specifies the design of four and three pole plugs. The five-contact audio plug 200 includes an insertion stop surface 228 at the proximal end of the sleeve contact 204. When the five-contact audio plug 200 is inserted in a jack 600 (FIG. 6) the insertion stop surface 228 abuts or is at least proximate an opening end 602 (FIG. 6) of the jack 600. In the latter case the surface 228 may not actually function as an insertion stop and another part (not shown e.g., acting on the tip contact 212) may act as an insertion stop.

According to the preferred embodiment the sleeve contact 204 serves as a first microphone terminal for the accessory (e.g., headset), the first ring contact 206 serves as a ground terminal for the accessory, the second ring contact 208 serves as a terminal for a right audio (speaker) channel, the third reduced diameter ring contact 210 serves as a second microphone terminal, and the tip contact 212 serves as a left audio (speaker) channel. When the five-pole plug 200 is part of a binaural microphone equipped headset, the aforementioned first microphone terminal may for example be a right side microphone and the aforementioned second microphone terminal may be for a left side microphone. A headset equipped with right and left microphones for binaural recording can also be used for noise cancelling. In the latter case the objective is to reduce the audible noise by adding a counteracting audio component to audio (e.g., music) played through the right and left speakers. Another type of noise cancelling is aimed at suppressing noise that is picked up along with the speaker's voice when a user is speaking into a microphone equipped head set. In the latter case one microphone may be located closer to the user's mouth and one further. When the five-pole plug 200 is part of the latter type of noise cancellation headset, one of the microphone terminals 204, 210 can be used by a microphone positioned closer to the speakers mouth and the other terminal 204, 210 for a second microphone positioned further.

In another case the two microphone terminals 204, 210 are used as a differential signal pair that is connected to the microphone, so as to reduce spurious noise induction on the microphone leads. In yet another case the third ring contact 210 can be used to transfer power either to or from the accessory, eliminating a need for separate power connector.

Figure 22:
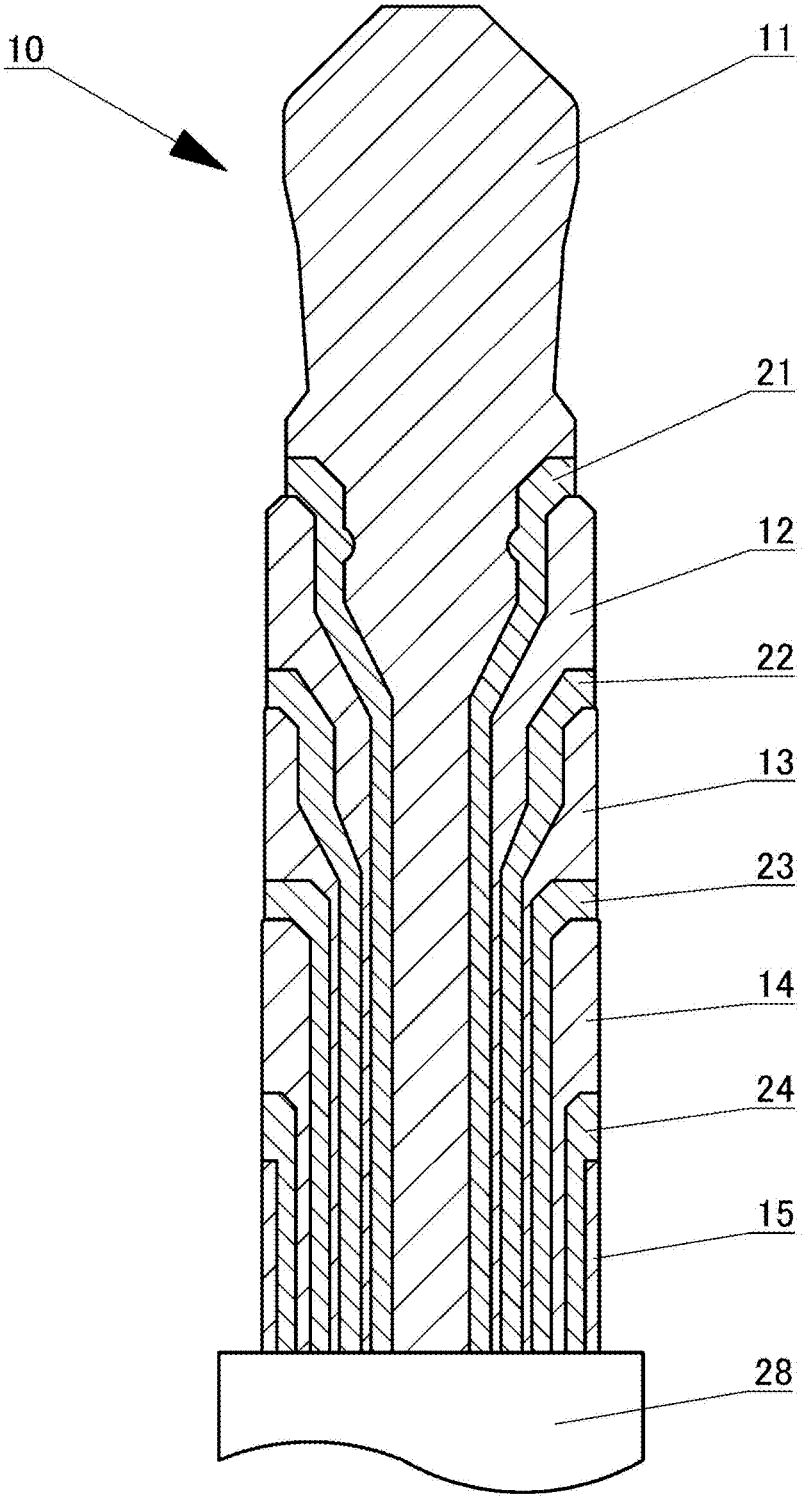
FIG. 22 is a prior art five-contact audio plug.

In contrast to the prior art five-contact plug 10 shown in FIG. 22 which squeezes its sleeve contact 15, first ring contact 14, second ring contact 13 and fourth ring contact 14 into the space that per the ITU P.381 standard only accommodates three contacts, the five contact plug 200 shown in FIG. 2 does not contract the length of the sleeve contact 204, first ring contact 206 or second ring contact 208. Thus the problems of shorting or open circuits due to design variances and manufacturing tolerances of the jack for the plug 10 do not arise. The present inventor has realized that the better place to position an additional ring contact is the tip region of the plug.

Referring again to FIG. 2, the reduced length tip contact 212 includes a first frusto conical portion 214, adjoining a second frusto conical portion 216. The first frusto conical portion 214 includes a first small end 218 positioned at the distal end of five-contact audio plug 200 and first large end 220 positioned closer to the proximal end of the five-contact audio plug 200. The second frusto conical portion 216 includes a second large end 222 adjoining the first large end 220 of the first frusto conical portion 214 and a second small end 224 closer to the proximal end of the five-contact audio plug 200. As the five-contact audio plug 200 is pushed into a jack the first frusto conical portion 214 deflects an associated jack contact (612, FIG. 6) radially outward. Upon further insertion, the associated jack contact comes to rest on the second frusto conical portion 216. Due to the tapering of the second frusto conical portion 216, the resilience of the associated jack contact exerts a retention force on the five contact audio plug. The contacts 204, 206, 208, 210, 212 are separated and held in position relative to each other by an insulating material 226.

Note that the third, smaller diameter ring contact 210 has a diameter that is smaller than the maximum diameter of the reduced length tip contact 212 (corresponding to the diameter of the large ends of the frusto conical portions 214, 216), and smaller than the diameter of the tip contact specified in the ITU P.381 standard which is 3.05 mm. This ensures that the third ring contact 210 cannot mechanically interfere with a insulation or any metal contacts of a jack that is designed to accept an ITU P.381 standard compliant plug.

Figure 3:
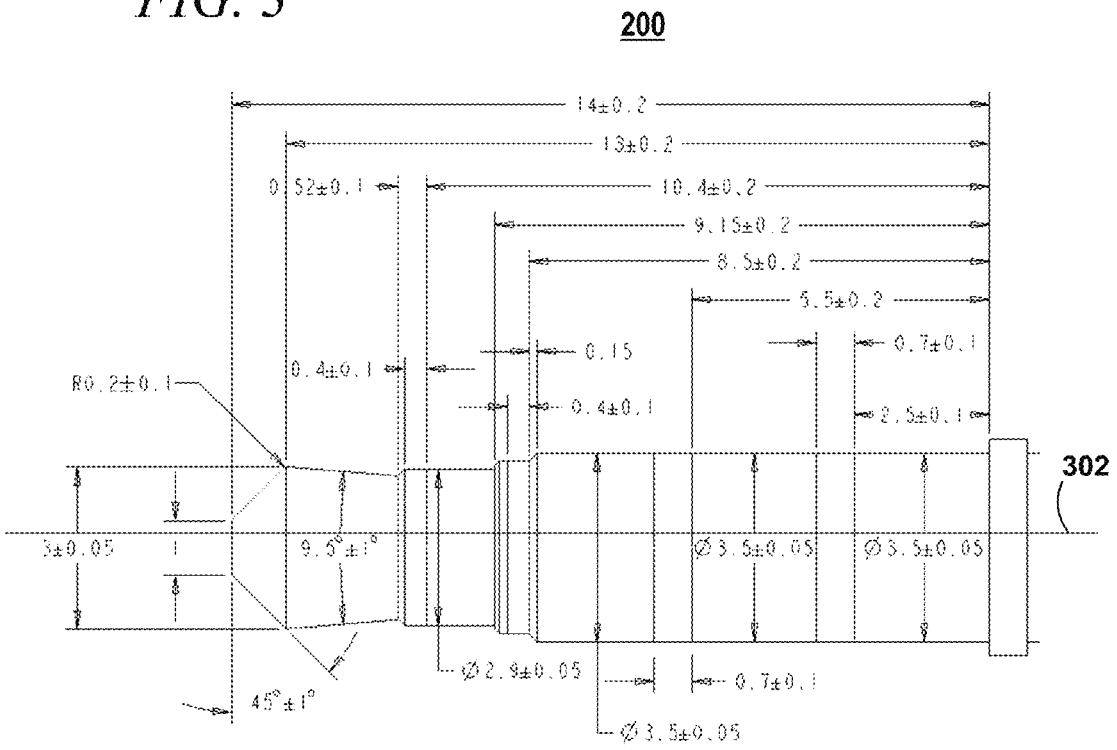
FIG. 3 is a dimensioned side view of the backward compatible five-contact audio plug shown in FIG. 2.

FIG. 3 is a dimensioned side view of the backward compatible five-contact audio plug 200 shown in FIG. 2 according to an embodiment of the invention. The third smaller ring contact 210 is preferably located entirely within an axial range that extends no more than 5.1 mm from the distal end of the audio plug 200 (which corresponds to the small end 218 of the first frustro conical portion 214, and more preferably within 4.75 mm from the distal end of the audio plug 200. The axial dimension referred to in phrase "axial range" is the dimension parallel to the longitudinal axis 302 shown in FIG. 3. The tip contact 212 is located within an axial range extending no more than 4.75 mm from the distal end.

The sleeve contact 204 is preferably located in an axial range that extends by no more than 2.95 mm from the surface 228. The first ring contact 206 is preferably located within an axial range that extends from 2.75 mm from the surface 228 to 6.5 mm from the surface 228. The second ring contact 208 is preferably located in an axial range that extends from 6.05 mm from surface 228 to 8.9 mm from surface 228. The third ring contact 210 is preferably located in an axial range that extends from 8.45 mm from the surface 228 to 10.85 mm from surface 228. Finally the reduced length tip contact 212 is preferably located in an axial range that extends from 10.35 mm from the surface 228 to 14.2) mm from the surface 228. More preferable, toleranced dimensions for the plug 200 are shown in FIG. 3. These tolerance dimensions imply somewhat narrower, more preferred limits on the axial range of the contacts 204, 206, 208, 210, 212.

Figure 4:
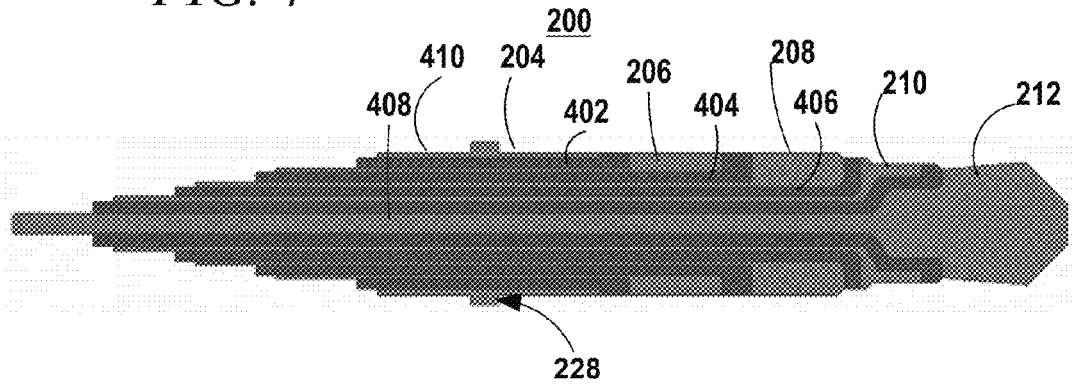
FIG. 4 is longitudinal cross-sectional view of the backward compatible five-contact audio plug shown in FIG. 2 without its rear housing/grip portion.

FIG. 4 is longitudinal cross-sectional view of the backward compatible five-contact audio plug shown in FIG. 2. FIG. 4 includes a rear portion of the plug that is enclosed in the rear housing/grip portion 202 (not shown in FIG. 4). As shown in FIG. 4, a first cylindrical conductor 402 extends to the left from the first ring contact 206 passing through the sleeve contact, a second cylindrical conductor 404 extends to the left from the second ring contact 208 passing through the first cylindrical conductor 402 and a third cylindrical conductor 406 extends to the left from the third ring contact 210 passing through the second cylindrical conductor 404. A pin conductor 408 extends to the left from the tip contact 212 passing through the third cylindrical conductor 406. The sleeve contact 204 includes a portion 410 that extends inside the rear housing grip portion 202 (to the left in FIG. 4). Left ends of the cylindrical conductors 402, 404, 406, the rear portion 410 of the sleeve contact 204, and the pin conductor 408 serve as terminals to which wires of a cable (not shown) can be connected (e.g., by soldering).

Figure 5:
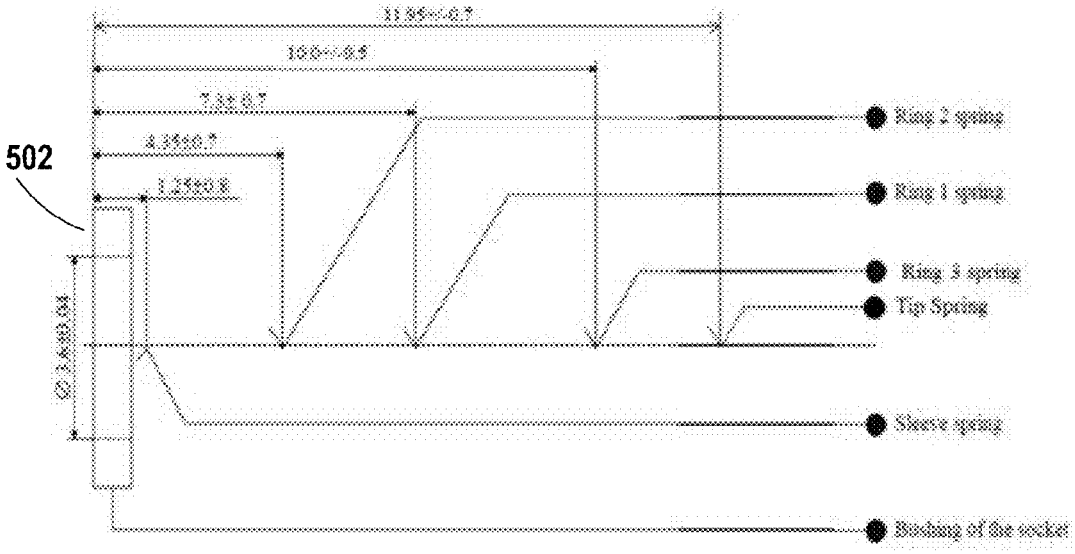
FIG. 5 is a schematic showing the positions of contacts of a five-contact jack that mates with the audio plug shown in FIG. 2.

FIG. 5 is a schematic drawing with acceptable positional tolerances showing preferable positions of contact touch points of a five-contact jack relative to an outer edge of the jack. If followed, recommendations on FIG. 5, will result in the jack being backwards compatible with the audio plugs shown in FIGS. 1 and 2.

Preferably the axial location at which the jack contact (612, FIG. 6) for the tip contact 212 touches the tip contact 212, which location is labeled "Tip Spring" in FIG. 5 is spaced from the axial location at which the jack contact (610, FIG. 6) for third, smaller ring contact 210 touches the smaller ring contact 210 which location is labeled "Ring 3 spring" in FIG. 5 by no more than 4.75 mm, and more preferably by a distance between 1.5 mm and 2.5 mm, for example by 1.95 mm (consistent with the nominal dimension shown in FIG. 5). It is equally desirable, that the distance between the contact point of Ring 3 spring and the outer edge 502 of the jack housing is between 9.5 mm and 10.5 mm, for example 10.0 mm. (as shown in FIG. 5) It should be understood, that these axial distances are not actual distance but rather are equivalent to projected distances in the field of view. Also, it should be noted, that contact points may lie anywhere along the circumference of the cylindrical contact and not necessarily in the same plane as the field of view presented in the figures.

Figure 6:
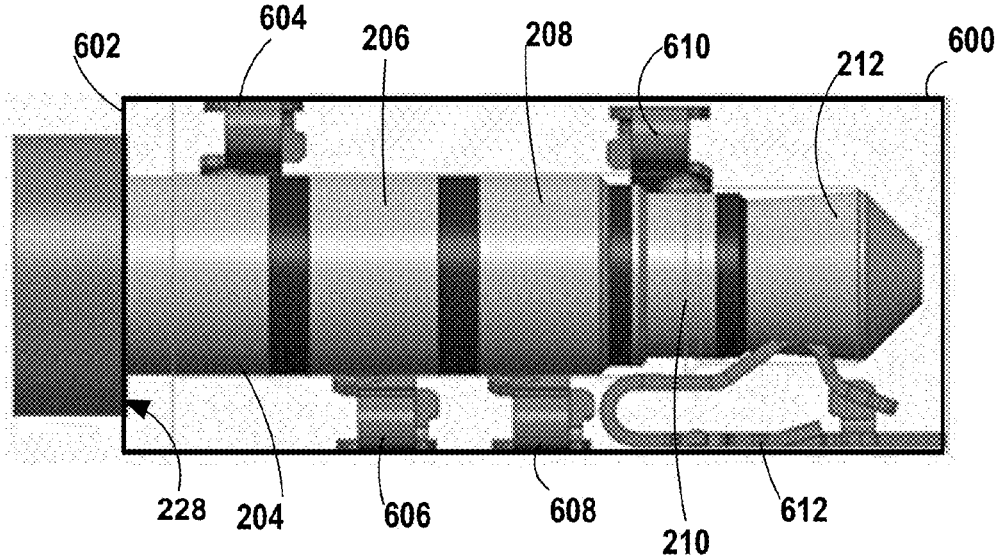
FIG. 6 is a side view of the five-contact plug shown in FIG. 2 inserted into a compatible five-contact jack.

FIG. 6 is a side view of the five-contact plug 200 shown in FIG. 2 inserted into a compatible five-contact jack 600. In order from an opening end 602 (referred to as the "outer edge" 502 in the context of FIG. 5) of the jack 600, the jack 600 includes a first jack contact 604, a second jack contact 606, a third jack contact 608, a fourth jack contact 610 and a fifth jack contact 612 which respectively contact the sleeve contact 204, the first ring contact 206, the second ring contact 208, the third, smaller ring contact 210 and the reduced length tip contact 212. The contacts are stampings made of a resilient conductive metal, such as mentioned above.

Figure 7:
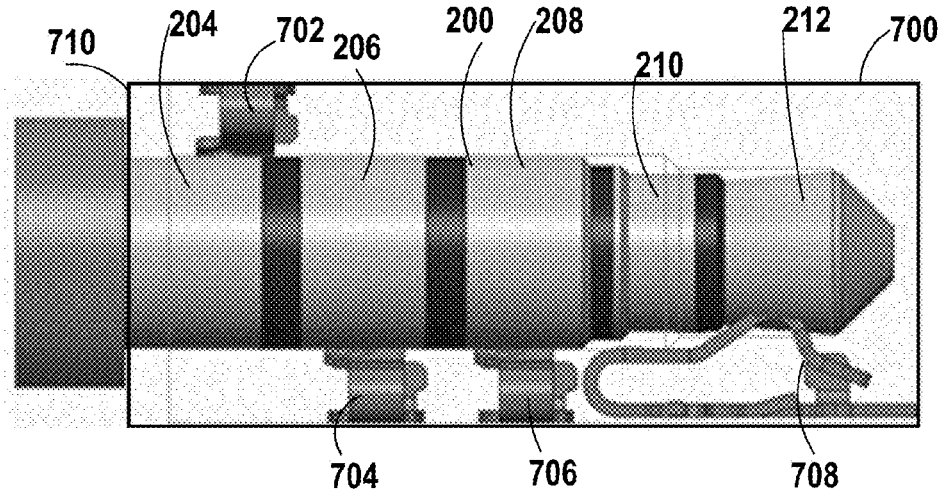
FIG. 7 is a side view of the five-contact plug shown in FIG. 2 along with four jack contacts of a four-contact jack, illustrating compatibility therewith.

FIG. 7 is a side view of the five-contact plug 200 shown in FIG. 2 along with four jack contacts 702, 704, 706, 708 of a four-contact jack 700, illustrating compatibility therewith. In order from an insertion end 710 of the jack 700 the jack contacts include a first jack contact 702, a second jack contact 704, a third jack contact 706 and a fourth jack contact 708 which respectively contact the plug's 200 sleeve contact 204, first ring contact 206, second ring contact 208 and tip contact 212. The third, smaller ring contact 210 remains unconnected to any contact of the jack 700. The jack contacts 702, 704, 706, 708 are designed in so far as the location of their contact points to work with an ITU P.381 standard compliant plug, however as shown in FIG. 7 the five-contact plug 200 of FIG. 2 also works with the jack. In other words the five-contact plug 200 is backward compatible with ITU P.381 standard compliant jacks.

Figure 8:
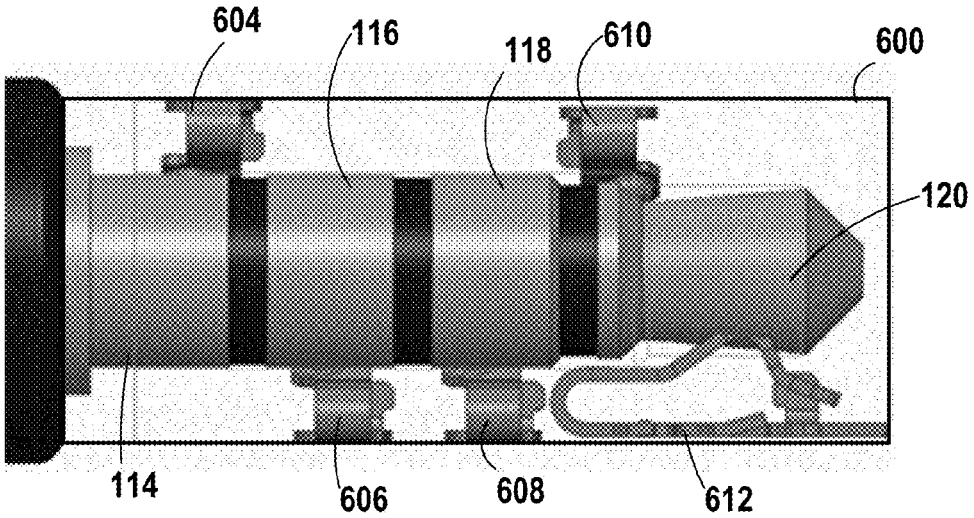
FIG. 8 is a side view of the four-contact plug shown in FIG. 1 along with five contacts of a five-contact jack, illustrating backward compatibility of the five-contact jack.

FIG. 8 is a side view of the four-contact plug 100 shown in FIG. 1 along with five contacts 604, 606, 608, 610, 612 of the five-contact jack 600, illustrating backward compatibility of the five-contact jack 600. In this case both the fourth contact 610 and the fifth contact 612 contact the tip contact 120 of the four-contact plug 100. However, this condition can be detected electronically by measuring the impedance between the fourth 610 and fifth contact 612 and in response to detecting this condition the fourth contact 610 can be disconnected leaving only the connection to the tip contact 120 via the fifth contact 612, and thus making the five-contact jack 600 backward compatible with ITU P.381 compliant four-contact audio plugs 100.

Figure 9:
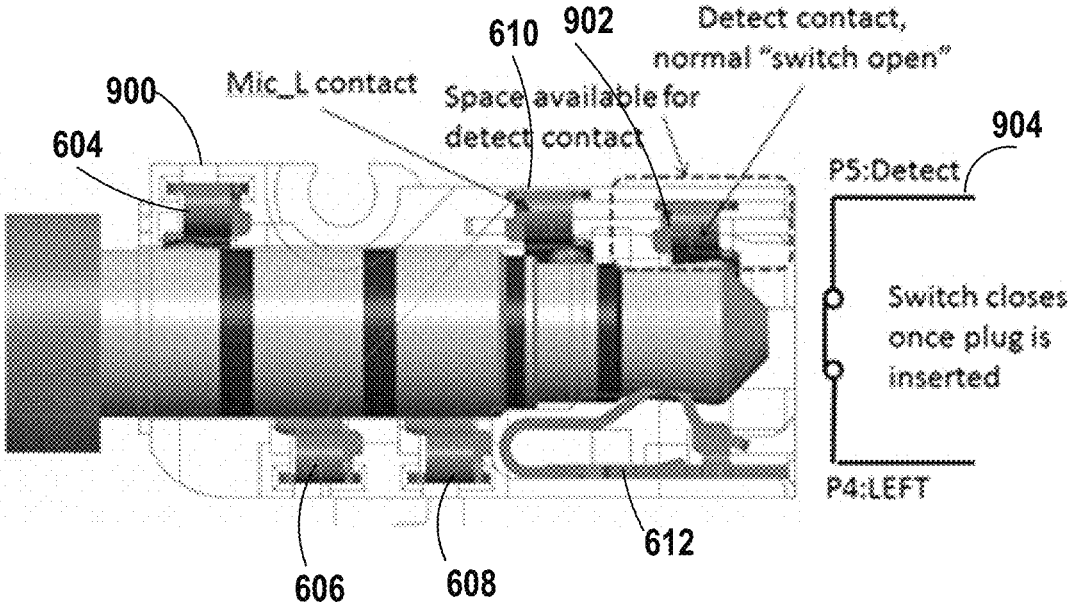
FIG. 9 is a side view of the five-contact plug shown in FIG. 2 inserted into a compatible five-contact jack that includes a first ("normal switch open") version of an insertion detection contact.

FIG. 9 is a side view of the five-contact plug 200 shown in FIG. 2 inserted into a compatible five-contact jack 900 that includes a first version of an insertion detection contact 902. Thus, in addition to the five jack contacts 602, 604, 606, 608, 610, 612 used to establish electrical connections to the contacts of an inserted plug, e.g., 100, 200, the jack 900 includes the additional insertion detection contact 902. When a plug, e.g., 100, 200 is inserted into the jack 900 the tip contact 120, 212 will bridge the fifth jack contact 612 and the insertion detection contact 902 thus completing a detection circuit 904 shown schematically at the right of FIG. 9.

Figure 10:
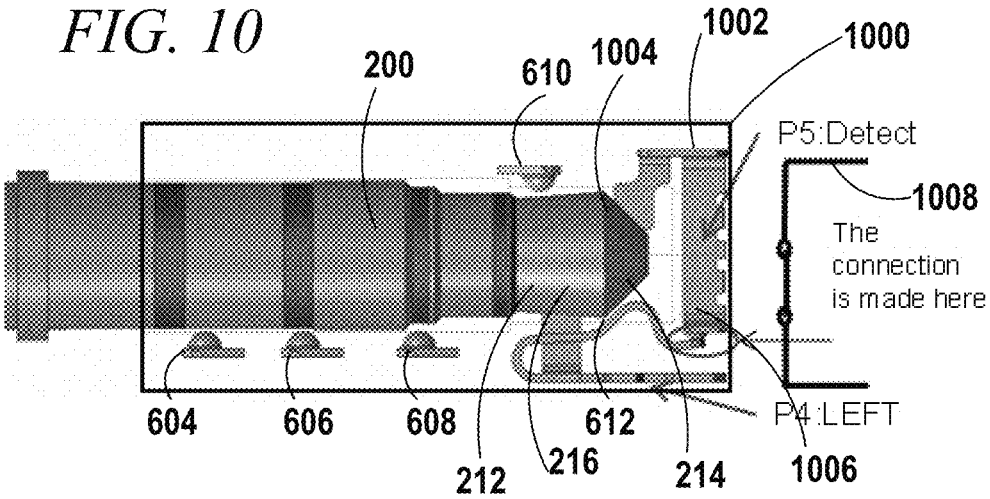
FIG. 10 is a side view of the five-contact plug shown in FIG. 2 inserted into a compatible five-contact jack that includes a second ("normal switch closed") version of an insertion detection contact with the plug partially inserted.
Figure 11:
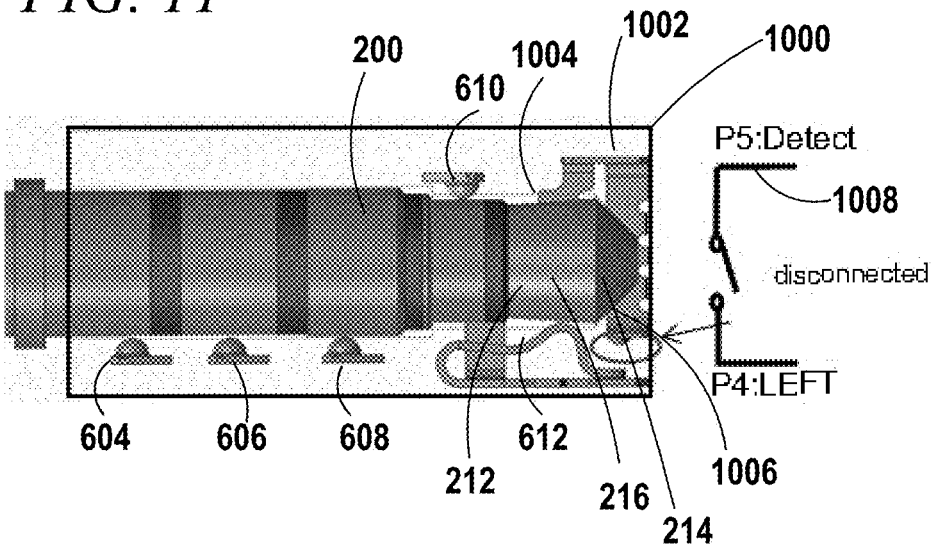
FIG. 11 is a side view of the five-contact plug shown in FIG. 2 inserted into the compatible five-contact jack that includes the second ("normal switch closed") version of an insertion detection contact, as shown in FIG. 10, with a plug fully inserted.

FIG. 10 is a side view of the five-contact plug 200 shown in FIG. 2 inserted into a compatible five-contact jack 1000 that includes a second version of an insertion detection contact 1002 In FIG. 10 the plug 200 is partially inserted and FIG. 11 shows the same arrangement with the plug 200 fully inserted. The detection contact 1002 can slide in the jack 1000 perpendicularly to the longitudinal axis of the plug 200. The detection contact 1002 includes a follower portion 1004 that engages the first (distal) frusto conical portion 214 of the tip contact 212. As the plug 200 is pushed into the jack 1000, the first frustro conical portion 214 pushes the detection contact 1002 by the follower portion 1004 upward causing a contact portion 1006 of the detection contact 1002 to disengage from the fifth contact 612 thereby opening a detection circuit 1008 which is schematically illustrated at the right of FIGS. 10-11.

Figure 12:
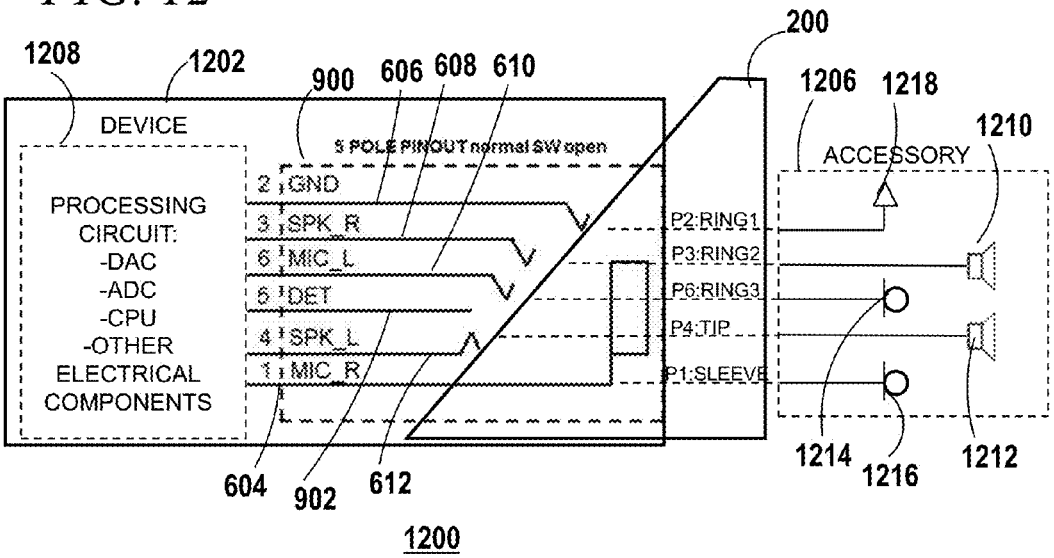
FIG. 12 is a schematic of a system including a device with a jack of the type shown in FIG. 9 along with an attached audio accessory.

FIG. 12 is a schematic of a system 1200 including a device 1202 with a jack 900 of the type shown in FIG. 9 along with an attached audio accessory 1206. The device 1202 includes a processing circuit 1208 that is electrically coupled to the jack contacts 604, 606, 608, 610, 612, 902. The five contact audio plug 900 is also represented schematically in FIG. 12. The accessory 1206 is suitably a headset that includes a right speaker 1210, a left speaker 1212 (e.g., left and right stereo speakers), a first microphone 1214, a second microphone 1216 and a ground 1218. The two microphones 1214, 1216 may be part of a binaural microphone or a noise cancellation system as discussed above. The processing circuit 1208 is able to determine the impedance between the second jack contact 606 which is grounded and the first jack contact 604, third jack contact 608, fourth jack contact 610 and fifth jack contact 612 and thereby determine what type of plug is inserted into the five-contact jack 600 thereby enabling backward compatibility. The specific sets of impedances that characterize different types of plugs inserted into the five-contact jacks 600, 900, 1000 are described below.

Figure 13:
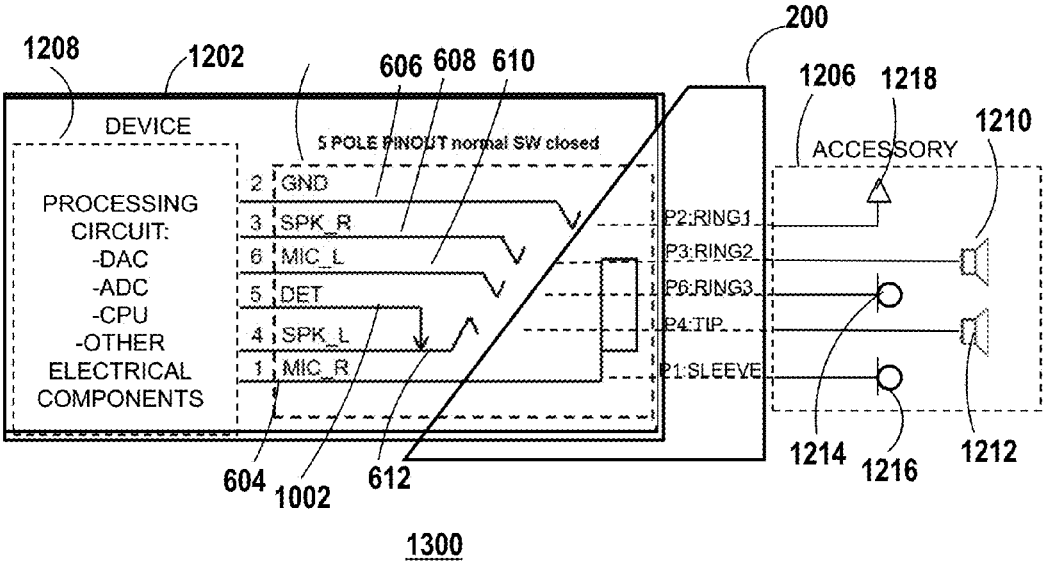
FIG. 13 is a schematic of a system including a device with a jack of the type shown in FIGS. 10-11 along with an attached audio accessory.

FIG. 13 is a schematic of a system 1300 including a device 1302 with a jack 1000 of the type shown in FIGS. 10-11 along with an attached audio accessory. Aside for the substitution of the jack of the type shown in FIGS. 10-11 for the jack 1000 shown in FIGS. 10-11, and the modification of the processing circuit 1208 to work with normally closed plug insertion detection contact 1002 as opposed to normally open plug insertion detection contact 902 the system 1300 shown in FIG. 13 is like the system 1200 shown in FIG. 12.

FIGS. 14-21 illustrate eight scenarios of plugs of various plug types inserted into various jack types. On the right side of each figure an impedance report indicates the impedances that are measured (e.g., by processing circuit 1208) between a jack ground contact (connected to a plug ground contact) and other jack contacts. Such a set of impedances can be used to recognize the type of plug that has been inserted into the jack. In each of FIGS. 14-21 a set of jack contacts is shown below the depicted plug. A schematic circuit represent an accessory that has one or more speakers and one or more microphones is shown above each depicted plug. The speakers and microphones are labeled with their typical impedances which is 32K Ohms in the case speakers and 2K Ohms in the case of microphones. The report at the right of each FIG. 14-21 is based on these impedances.

Figure 14:
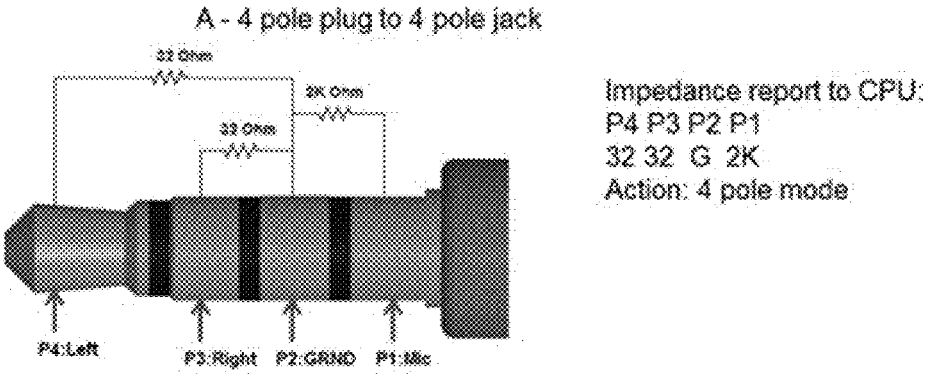
FIG. 14 is a schematic illustrating impedances measured to identify a situation in which the four-contact plug as shown in FIG. 1 is inserted into a compatible four-contact jack.

FIG. 14 is a schematic illustrating impedances measured to identify a situation in which the four-contact plug 100 as shown in FIG. 1 is inserted into a compatible four-contact jack 110.

Figure 15:
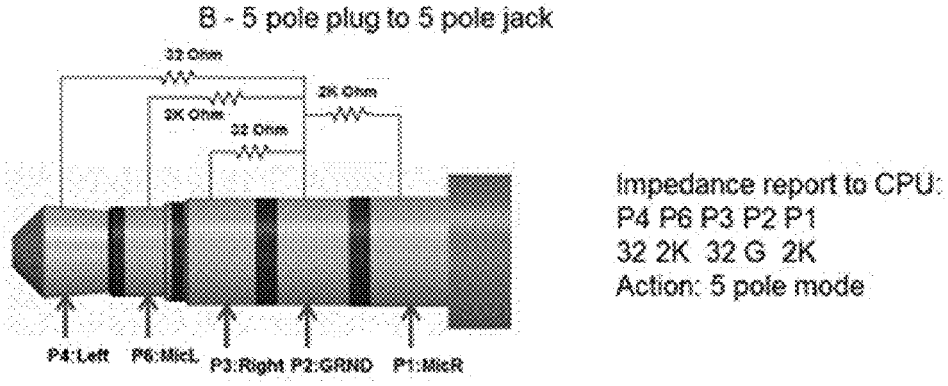
FIG. 15 is a schematic illustrating impedances measured to identify a situation in which the five-contact plug as shown in FIG. 2 is inserted into the backward compatible five-contact jack shown in FIG. 6.

FIG. 15 is a schematic illustrating impedances measured to identify a situation in which the five-contact plug 200 as shown in FIG. 2 is inserted into the backward compatible five-contact jack 600 shown in FIG. 6.

Figure 16:
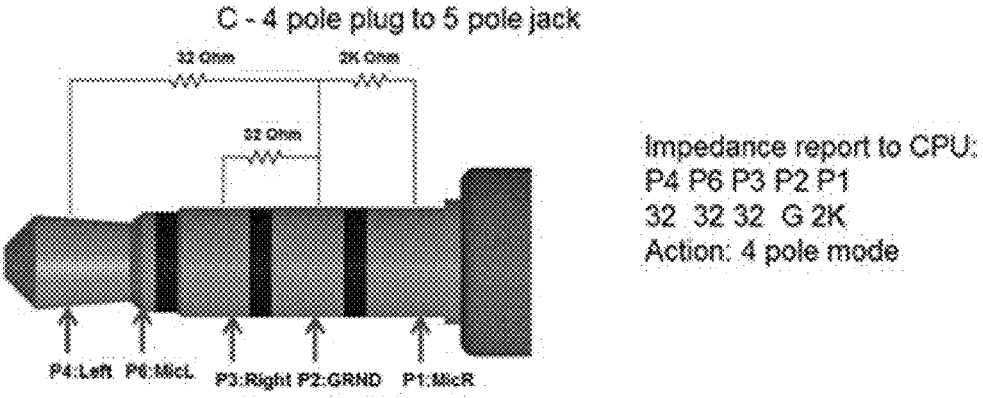
FIG. 16 is a schematic illustrating impedances measured to identify a situation in which the four-contact plug as shown in FIG. 1 is inserted into a backward compatible five-contact jack shown in FIG. 6.

FIG. 16 is a schematic illustrating impedances measured to identify a situation in which the four-contact plug 100 as shown in FIG. 1 is inserted into a backward compatible five-contact jack 600 shown in FIG. 6.

Figure 17:
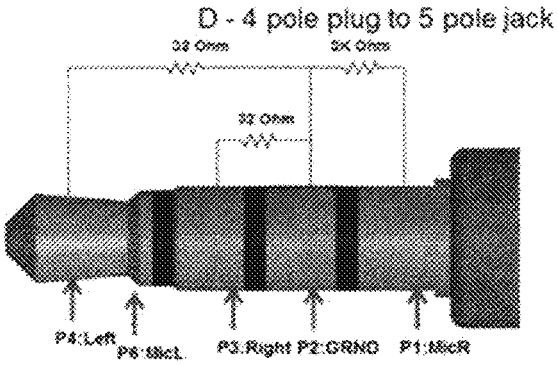
FIG. 17 is a schematic illustrating impedances measured to identify a situation in which the four-contact plug as shown in FIG. 1 is inserted into the backward compatible five-contact jack shown in FIG. 6.

FIG. 17 is a schematic illustrating impedances measured to identify another situation in which the four-contact plug 100 as shown in FIG. 1 is inserted into the backward compatible five-contact jack 600 shown in FIG. 6. The situations shown in FIGS. 16 and 17 are distinguished by the fact that in the case of FIG. 16 the fourth jack contact 610 that engages the third smaller ring contact 210 of the five-contact audio plug 200 is designed with such geometry that it makes contact with the tip contact 120 of the four-contact plug 100 and in the case of FIG. 17 the fourth jack contact 610 is designed to clear the tip contact 120 of the four-contact plug 100.

Figure 18:
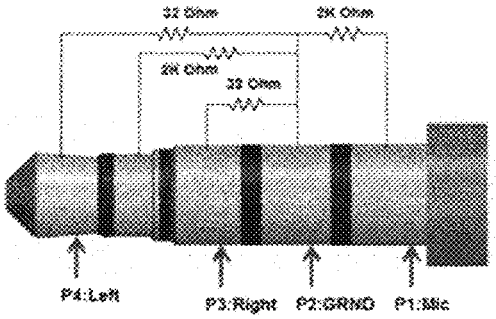
FIG. 18 is a schematic illustrating impedances measured to identify a situation in which the five-contact plug as shown in FIG. 2 is inserted into a legacy four-contact jack.

FIG. 18 is a schematic illustrating impedances measured to identify a situation in which the five-contact plug 200 as shown in FIG. 2 is inserted into a legacy four-contact jack 110.

Figure 19:
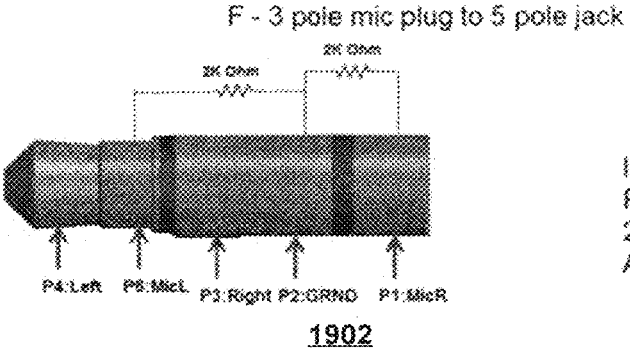
FIG. 19 is a schematic illustrating impedances measured to identify a situation in which a three-contact microphone plug is inserted into a backward compatible five-contact jack shown in FIG. 6.

FIG. 19 is a schematic illustrating impedances measured to identify a situation in which a three-contact microphone plug 1902 is inserted into a backward compatible five-contact jack 600 shown in FIG. 6.

Figure 20:
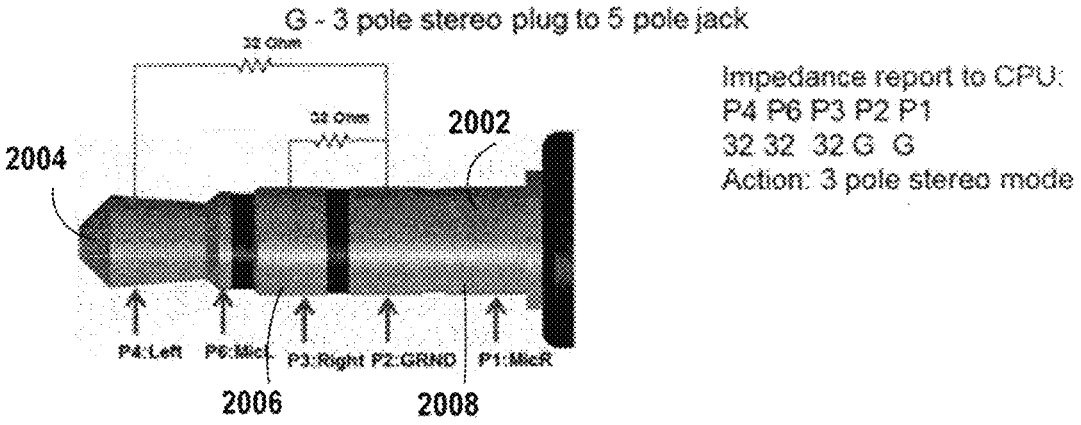
FIG. 20 is a schematic illustrating impedances measured to identify a first situation in which a three-contact stereo plug is inserted into a backward compatible five-contact jack shown in FIG. 6.

FIG. 20 is a schematic illustrating impedances measured to identify a first situation in which a three-contact stereo plug 2002 is inserted into a backward compatible five-contact jack 600 shown in FIG. 6. The three-contact stereo plug 2002 includes a tip contact 2004, a ring contact 2006 and a sleeve contact 2008.

Figure 21:
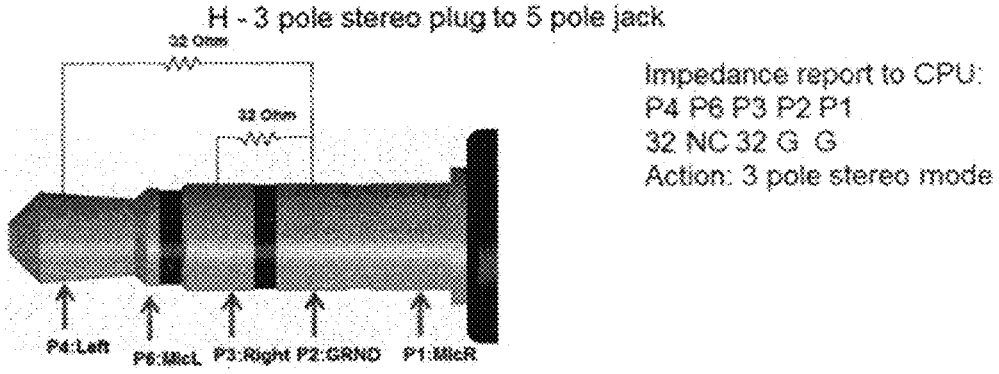
FIG. 21 is a schematic illustrating impedances measured to identify a second situation in which the three-contact stereo plug is inserted into a backward compatible five-contact jack shown in FIG. 6.

FIG. 21 is a schematic illustrating impedances measured to identify a second situation in which the three-contact stereo plug 2002 is inserted into a backward compatible five-contact jack 600 shown in FIG. 6.

The distinction between FIG. 20 and FIG. 21 is analogous to the distinction between FIG. 16 and FIG. 17 described above in so far as in the case of FIG. 20 the fourth jack contact 610 that engages the third smaller ring contact 210 of the five-contact audio plug 200 is designed with such geometry that it makes contact with a tip contact 2004 of the four-contact plug 100 and in the case of FIG. 21 the fourth jack contact 610 is designed to clear the tip contact 2004 of the four-contact plug 100.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of audio plug type detection described herein. The non-processor circuits may include, but are not limited to, a radio receiver, a radio transmitter, signal drivers, clock circuits, power source circuits, and user input devices. As such, these functions may be interpreted as steps of a method to perform audio plug type detection. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. An audio plug fittable into an audio jack having a longitudinally extending chamber, an opening into the longitudinally extending chamber for receiving audio plug, a set of four or five jack electrical contacts each having one of the four or five jack contact portions for engaging the audio plug, the four or five jack contact portions being spaced longitudinally in the longitudinally extending chamber, wherein starting from the opening the four or five jack contact portions include a first jack contact portion for engaging a sleeve contact, a second jack contact portion for engaging a first ring contact, a third jack contact portion for engaging a second ring contact, an optional jack contact portion for engaging a third ring contact and a fourth jack contact portion for engaging a tip contact, the audio plug comprising, arranged in order starting at a proximal end and ending at a distal end, a set of five electrical contacts including:

a sleeve contact located at a first axial position on the audio plug, the first axial position being proximate the proximal end, a first ring contact located at a second axial position on the audio plug, a second ring contact located at a third axial position on the audio plug, a third ring contact located at a fourth axial position on the audio plug, and a tip contact located at the distal end of the audio plug, the tip contact including a first frustro conical portion and a second frustro conical portion, the first frustro conical portion having a first small end located proximate the distal end of the audio plug and a first large end that is located closer to the proximal end of the cylindrical audio plug than is the first small end of the first frustro conical portion, the second frustro conical portion including a second large end and a second small end, the second large end being located closer to the distal end of the cylindrical audio plug than is the second small end;

the third ring contact and the tip contact being located within an axial portion of the audio plug that extends 4.85 mm+/−0.2 mm from the distal end toward the proximal end; a maximum diameter of the third ring contact is not greater than a maximum diameter of the tip contact.

2. The audio plug according to claim 1 wherein the third ring contact has a diameter of 2.9 mm+/−0.05 mm.

3. An audio jack comprising:

a longitudinally extending chamber, an opening into the longitudinally extending chamber for receiving an elongated audio plug, a set of five jack electrical contacts each having one of five jack contact portions for engaging the elongated audio plug, the five jack contact portions being spaced longitudinally in the longitudinally extending chamber, wherein starting from the opening the five jack contact portions include a first jack contact portion, a second jack contact portion, a third jack contact portion, a fourth jack contact portion and a fifth jack contact portion, wherein the fourth jack contact portion and the fifth jack contact portion are positioned within a distance that is between 1.5 mm and 2.5 mm from each other, and a processing circuit operatively coupled to at least the fourth jack contact portion and configured to determine what type of plug is inserted into the set of five jack electrical contacts.

4. The electrical apparatus according to claim 3 wherein the processing circuit is also operatively coupled to at least the second contact portion.

5. The audio jack according to claim 3 wherein the fourth jack contact portion comprises a spring orifice having a nominal deflective width at a contact point of 2.9 mm+/−0.05 mm.

6. The audio jack according to claim 3 wherein a spring orifice of the fourth jack contact portion has a nominal deflective width at a contact point narrower than nominal deflective widths at a contact points of spring orifices of each of the first jack contact portion, the second jack contact portion, and the third jack contact portion.

7. A system for coupling an electronic apparatus to an audio accessory, the system comprising:

an audio plug comprising:

arranged in order starting at a proximal end and ending at a distal end a set of five electrical contacts including:

a sleeve contact located at first axial position on the audio plug, the first axial position being proximate the proximal end, a first ring contact located at a second axial position on the audio plug, a second ring contact located at a third axial position on the audio plug, a third ring contact located at a fourth axial position on the audio plug, and a tip contact located at the distal end of the audio plug, the tip contact including a first frustro conical portion and a second frustro conical portion, the first frustro conical portion having a first small end located proximate the distal end of the audio plug and a first large end that is located closer to the proximal end of the cylindrical audio plug than is the first small end of the first frustro conical portion, the second frustro conical portion including a second large end and a second small end, the second large end being located closer to the distal end of the cylindrical audio plug than is the second small end;

the third ring contact and the tip contact being located within an axial portion of the audio plug that extends 4.85 mm+/−0.2 mm from the distal end toward the proximal end;

a maximum diameter of the third ring contact is not greater than a maximum diameter of the fifth tip contact; and an audio jack comprising:

a longitudinally extending chamber, an opening into the longitudinally extending chamber for receiving audio plug, a set of five jack electrical contacts each having one of five jack contact portions for engaging the audio plug, the five jack contact portions being spaced longitudinally in the longitudinally extending chamber, wherein starting from the opening the five jack contact portions include a first jack contact portion for engaging the sleeve contact, a second jack contact portion for engaging the first ring contact, a third jack contact portion for engaging the second ring contact, a fourth jack contact portion for engaging the third ring contact and a fifth jack contact portion for engaging the tip contact, wherein the fourth jack contact portion and the fifth jack contact portion contact are positioned within a distance that is between 1.5 mm and 2.5 mm from each other.

8. The system according to claim 7 wherein the audio jack further comprises a processing circuit operatively coupled to at least the fourth jack contact portion and configured to determine what type of plug is inserted into the set of five jack electrical contacts.

9. The system according to claim 7 wherein the third ring contact of the audio plug has a diameter of 2.9 mm+/−0.05 mm.

* * * * *